US010293596B2

(12) United States Patent
Vogt

(10) Patent No.: US 10,293,596 B2
(45) Date of Patent: May 21, 2019

(54) PAD PRINTING MACHINE

(71) Applicant: ITW Morlock GmbH, Dornstetten (DE)

(72) Inventor: Udo Vogt, Baden-Baden (DE)

(73) Assignee: ITW MORLOCK GMBH, Dornstetten (DE)

( * ) Notice: Subject to any disclaimer, the term of this patent is extended or adjusted under 35 U.S.C. 154(b) by 0 days.

(21) Appl. No.: 13/866,485

(22) Filed: Apr. 19, 2013

(65) Prior Publication Data

US 2013/0333581 A1 Dec. 19, 2013

Related U.S. Application Data

(63) Continuation of application No. 12/933,985, filed as application No. PCT/IB2009/051575 on Apr. 15, 2009, now abandoned.

(30) Foreign Application Priority Data

May 8, 2008 (DE) ..... 10 2008 022 876

(51) Int. Cl.
*B41F 17/00* (2006.01)

(52) U.S. Cl.
CPC ..... *B41F 17/001* (2013.01)

(58) Field of Classification Search
CPC ..... B41F 17/001
USPC ..... 101/41, 163
See application file for complete search history.

(56) References Cited

U.S. PATENT DOCUMENTS

| | | | | |
|---|---|---|---|---|
| 5,557,154 | A | 9/1996 | Erhart | |
| 6,550,381 | B1 * | 4/2003 | Guastaferri | B41F 17/001 101/163 |
| 7,244,279 | B2 * | 7/2007 | Seitz | B41F 17/001 257/E21.011 |
| 2002/0033320 | A1 | 3/2002 | Matsuoka et al. | |
| 2006/0213380 | A1 | 9/2006 | Reinholdt | |
| 2008/0110704 | A1 | 5/2008 | Nakazeki | |
| 2008/0314266 | A1 * | 12/2008 | Reinholdt | B41F 17/001 101/40 |
| 2011/0023737 | A1 * | 2/2011 | Vogt | 101/163 |

FOREIGN PATENT DOCUMENTS

| | | | | |
|---|---|---|---|---|
| CN | 1348914 | A | 5/2002 | |
| CN | 101103215 | A | 1/2008 | |
| DE | 8328627 | U1 | 3/1985 | |
| DE | 19637526 | A1 | 3/1998 | |
| DE | 102005060550 | A1 | 6/2007 | |
| EP | 0671070 | A1 | 9/1995 | |
| WO | 9508860 | A1 | 3/1995 | |
| WO | WO 2007069023 | A2 * | 6/2007 | B41F 17/001 |

OTHER PUBLICATIONS

First Examination Report issued in Indian Application No. 6848/CHENP/2010 dated Nov. 4, 2016.

* cited by examiner

*Primary Examiner* — Matthew G Marini
*Assistant Examiner* — Leo T Hinze
(74) *Attorney, Agent, or Firm* — Pilloff & Passino LLP; Martin J. Cosenza

(57) ABSTRACT

A pad printing machine comprising at least one inverted planetary roller threaded drive (12; 24; 36; 48; 60; 62) and application of latter to a pad printing machine.

19 Claims, 2 Drawing Sheets

PAD PRINTING MACHINE

Figure 1:
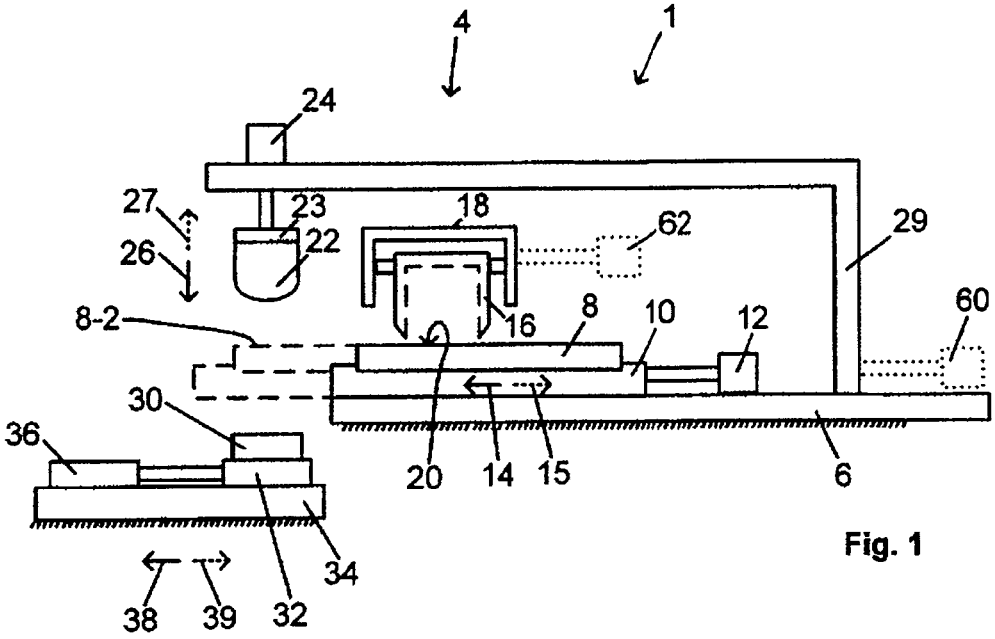

The present invention relates to a pad printing machine depicted by way of example in FIG. 1 by reference numeral 1.

The present invention furthermore relates to using an inverted planetary roller threaded drive to displace and position at least one displaceable sub-assembly of a pad printing machine.

Pad printing machines are known for instance from the patent documents EP 1 636 031 B1 and DE 10 2005 060 550 A1.

Electrically adjusting cylinders fitted with a planetary roller threaded drive are known for instance from the patent document EP 0 671 070 B1 (=DE 694 16 818 T2).

The objective of the present invention is to solve the problem of more accurately controlling the pad printing machine.

The invention solves this problem by the features of the independent claims. Preferred embodiment modes are defined in the dependent claims.

Accordingly the present invention concerns a pad printing machine comprising at least one displaceable sub-assembly configured displaceably relative to at least one second sub-assembly, further an electric, adjusting linear-actuator which is mechanically connected to the minimum of one displaceable first sub-assembly to drive it, characterized in that the electric, adjusting linear-actuator is fitted with an inverted planetary roller threaded drive.

Furthermore the present invention relates to the application of at least one linear adjusting actuator fitted with an inverted planetary roller threaded drive to move at least one displaceable first sub-assembly relative to at least one second sub-assembly of a pad printing machine.

The displaceable first sub-assembly illustratively my be a printing plate support, an ink cup support, a pad support, an object support holding an object to be/being printed, and/or a displaceable printing-unit carrier for one or two or more pad printing units.

The electric, adjusting linear-actuator (electric adjusting cylinder) containing the inverted planetary roller threaded drive offers the advantage over compressed air controls that the speeds and positions of displaceable components of the pad printing machine can be controlled accurately. Accurate time-dependent and/or path-dependent compressive forces may be set and holding durations for displaceable components can be defined. Moreover they may exert large forces while being very compact.

A control system driving the inverted planetary roller threaded drive may be hard programmed or preferably be optionally programmable. Also ink withdrawals and ink depositions may be programmed.

The present invention allows substantially improving, a least in part, printing quality.

The electric, adjusting linear-actuator (electric adjusting cylinder) of the present invention fitted with the inverted planetary roller threaded drive may replace totally pneumatic or hydraulic actuators heretofore required to attain similarly high forces in pad printing machines, however without incurring the drawbacks regarding maintenance or possible leakages of pneumatic or hydraulic actuators. Ordinarily hydraulic actuators may not be used with pad printing machines because of the danger of leakage. On the other hand the novel actuator of the present invention is applicable even to the so-called clean rooms.

Planetary roller threaded drives and their controls are known for instance from the patent document EP 0 671 070 B1 (=DE 694 16 818 T2).

The present invention is elucidated below in relation to the appended drawings of preferred illustrative embodiment modes.

Figure 2:
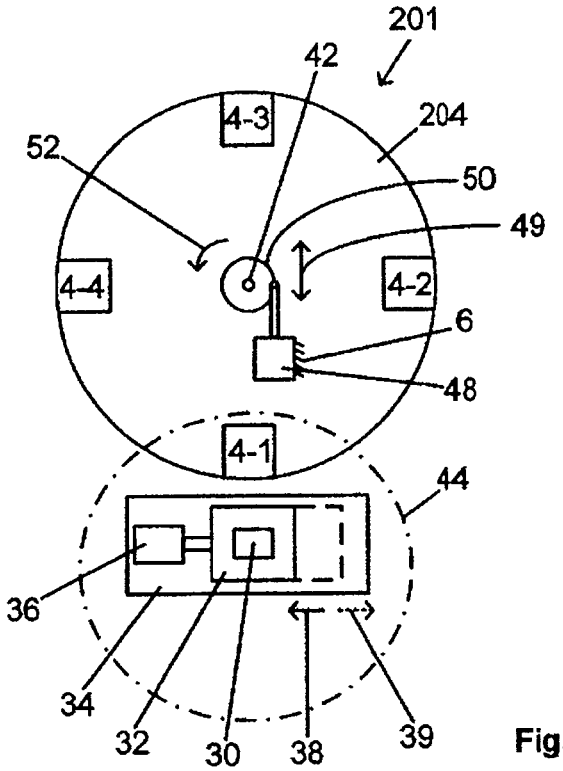
Figure 3:
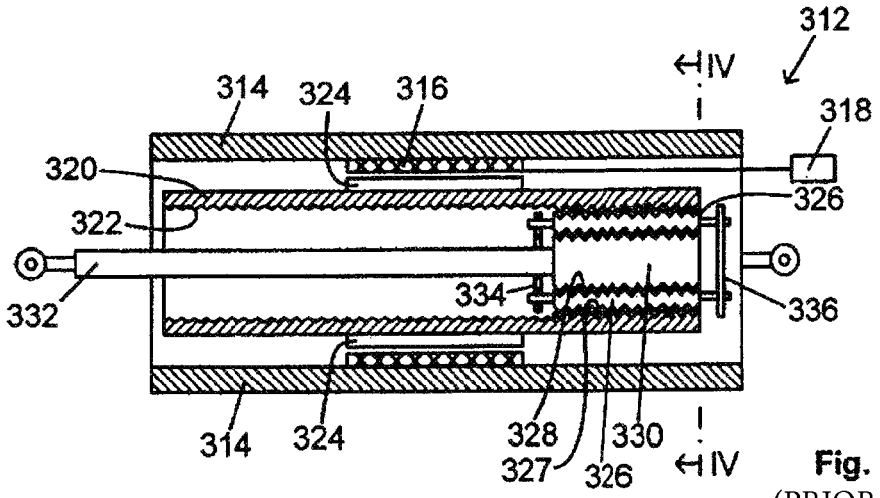
Fig. 3 (PRIOR ART)
Figure 4:
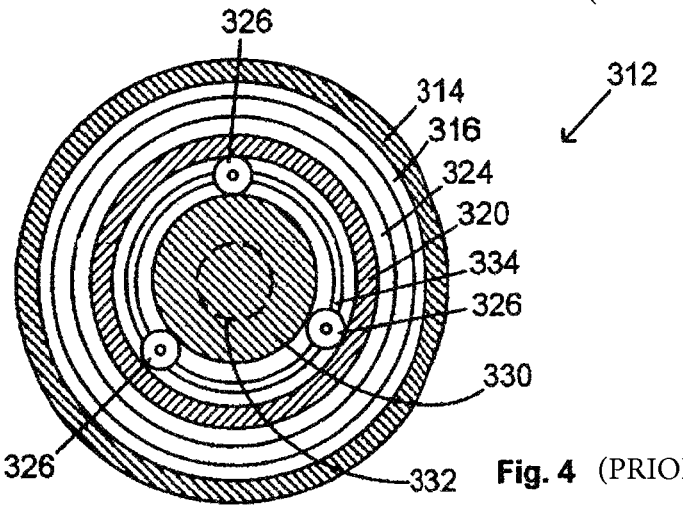
Fig. 4 (PRIOR ART)
Figure 5:
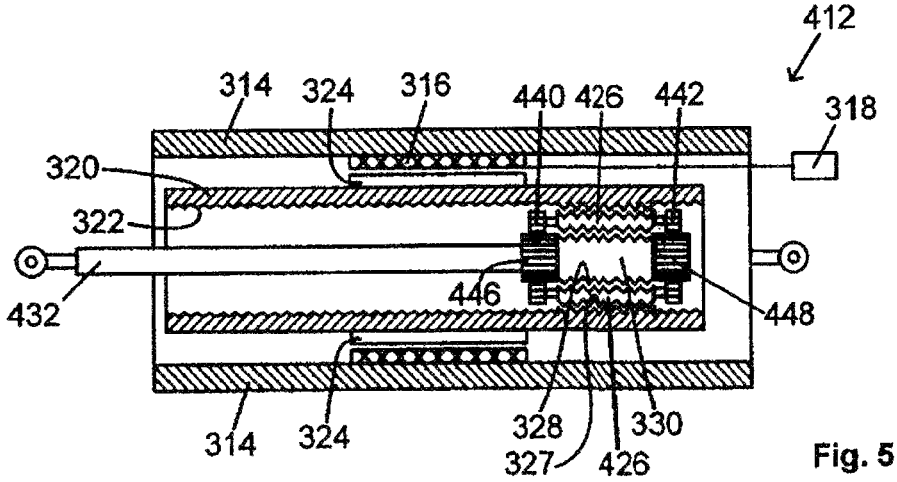
Fig. 5 (PRIOR ART)

FIG. 1 is a schematic side view of a printing unit and an object carrier of a pad printing machine of the invention, FIG. 2 is a schematic top view of a pad printing machine of several printing units, FIG. 3 is a schematic longitudinal section of an electric linear actuator (electrical adjusting cylinder) fitted with an inverted planetary roller threaded drive used in a pad printing machine of the invention, FIG. 4 schematically shows a cross-section in the plane IV-IV of FIG. 3, and FIG. 5 is a schematic longitudinal section of a further embodiment mode of an electrical, adjusting linear-actuator (electrical adjusting cylinder) fitted with inverted planetary roller threaded drive to be used in a pad printing machine of the present invention.

The pad printing machine 1 schematically shown in FIG. 1 contains a printing unit 4. This printing unit 4 contains a printing-unit support 6 which directly rests on a printing plate 8 or, as shown in FIG. 1, rests on a printing plate base 10, and which is reciprocated according to arrows 14 and 15 by an electric, adjusting linear-actuator 12 between the ink receiving position indicated in FIG. 1 by a solid line and an ink transfer position as indicated in said Figure by dashed lines. In FIG. 1 the adjusting linear-actuator 12 is configured between the printing plate support 10 and the printing unit 6 and may displace the former relative to the latter.

An ink cup 16 is situated on the printing plate 8 and is kept stationary in a predetermined position by an ink cup support 18 and is shown in the ink receiving position of the printing plate 8 above at least one recess 20 in said plate 8, whereby ink contained in the ink cup 16 can enter the recess(es) 20. The minimum of one recess 20 is in the shape of the printed image (image or text) as yet to be printed.

The ink cup 16 remains in the position shown in FIG. 1 even when the printing plate 8 is moved from the position shown in solid lines into forward into the ink transfer position wherein the printing plate 8 is denoted by the reference 8-2. When the printing plate 18 is in the ink transfer position where it is denoted by 8-2, a pad 22 can be lowered by means of a second electric, adjusting linear-actuator 24 (electric adjusting cylinder) from the upper initial position shown in FIG. 1 in the direction shown by an arrow 26 onto the recess(es) 20 of the printing plate 8, in order to absorb the printing ink therein. Next the pad 22 is moved upward as shown by an arrow 27 by means of the electric, adjusting linear-actuator 24. Then the printing plate 8 can be returned into its ink-receiving position shown by solid lines in FIG. 1 by means of the first electric, adjusting linear-actuator 12.

The second electric, adjusting linear-actuator 24 is mechanically connected on one hand to a pad support 23 of the pad 22 and on the other hand by a pad support 29 to the printing unit 6.

Thereupon the pad 22 can be by means of the second electric, adjusting linear-actuator 24 again as indicated by the same vertical arrows 26 respectively 27 down onto an object to be printed 30 and then back up in order to transfer the ink to the object being printed 30.

The object to be/being printed 30 is situated on an object carrier 32. This object carrier 32 may be configured to be stationary or be displaceable on an object base 34 by means of a third electric, adjusting linear-actuator 36 (electrical adjusting cylinder) between the printing position shown in FIG. 1 and an object deposition position away from said object printing position, for instance as indicated by the respective arrows 38 and 39.

The further embodiment mode of a pad printing machine of the present invention shown in FIG. 2 contains several, for instance four printing units 4-1, 4-2, 4-3 and 4-4 which are mounted on a printing unit carrier 204 rotatable about a vertical axis of rotation 42, each of said printing units 4-1 through 4-4 corresponding to a printing unit 4 of FIG. 1. These printing units 4-1 through 4-4 rotate jointly with the printing carrier 204 sequentially past a printing station 44 where an object 30 is printed. As shown in FIG. 1, the object to be/being printed 30 again may be located on the object carrier 32. Said object carrier can be mounted on an object base 14. The object carrier 32 may be displaced by a third electric, adjusting linear-actuator 36 (electric adjusting cylinder) as indicated by the arrows 38 respectively 39.

The printing unit carrier 204 of FIG. 2 may be rotated for instance by an electric or pneumatic actuator, in particular a rotational actuator, or by a fourth electric, adjusting linear-actuator 48 of which the linear displacement is converted as indicated by double arrow 49 by means of an idler mechanism 50 into a rotational displacement of the printing unit carrier 204, for instance clockwise as indicated by an arrow 52.

Identical/corresponding components shown in FIGS. 1 and 2 are denoted by the same references below. There are variations: the printing unit carrier 6 and the object base 34 (or object carrier 32) of FIG. 1 may be separate components or they may be a single component. A fifth electric, adjusting linear-actuator 60 (electrical adjusting cylinder) may be used to horizontally displace the printing plate carrier 10 and/or a sixth electric, adjusting linear-actuator 62 may serve to position the ink cup 16 on the printing plate 8. The fifth and sixth linear adjusting actuators 60 respectively 62 are represented by dotted lines. The terminology of "first, second, third, fourth, fifth and sixth electric, adjusting linear-actuator" does not define a definite number nor a definite sequence of the electric, adjusting linear-actuators, instead it serves only to describe them individually and to distinguish between them.

At least one of electric, adjusting linear-actuators (electric adjusting cylinder) 12, 24, 36, 48, 60 and/or 62 contains an inverted planetary roller threaded drive and preferably also a computerized control associated with said drive which preferably is programmed/programmable to match predetermined pad printing procedures. Possible embodiment modes of such electric, adjusting linear-actuators fitted with a planetary roller threaded drive and with a corresponding control illustratively are known from the EP 0 671 070 B1 patent document and are briefly discussed below.

The electric, adjusting linear-actuator 312 schematically shown in FIGS. 3 and 4 comprises an external pipe 314 fitted with an electric motor winding 316 on its inside so that said pipe and winding together constitute an electric motor stator 314/316. The motor winding 316 is driven by an electric control 318 and fed by it with electric power. The external pipe 314 comprises radially inside the motor winding 316 an inner pipe 320 that is fitted with an internal thread 322 and with permanent magnets 324 at its outside. Together with its permanent magnet 324, the inner pipe 320 constitutes the electric motor's rotor 320/324.

Several planetary rollers 326—which are fitted with an outer thread 327 matching the inner thread 322 of the inner pipe 320—are distributed around the inner circumference of the inner pipe 320 and engage the inner thread 322 of the inner pipe 320. The outer thread 327 of the planetary rollers 326 also engages the external, circumferential grooves 328 of a drive segment 330 fashioned at one end of a drive spindle 332. The drive segment 330 is part of the drive spindle 332 or irrotationally joined to it. The drive spindle 332 may be solid or tubular.

The outer circumferential grooves 328 of the drive segment 330 may consist of a threaded groove or of individual annular grooves.

The planetary rollers 326 may be kept apart from each other for instance by rings 334 and 336

When rotating the rotor 320/324 constituted by the inner pipe 320 and the permanent magnets 324, the planetary rollers 326 are axially moved relative to the said pipe 320 in its inside thread 322. In the process the planetary rollers 326 axially entrain the drive segment 330 and the drive spindle 332 connected to or integral with said drive segment, as a result of which the said drive spindle is axially displaced relative to the inside pipe 320 and hence also relative to the outer pipe 314.

The further electrical, adjusting linear-actuator 412 shown in FIG. 5 is similar to the linear adjusting actuator 312 of FIGS. 3 and 4, except that the circumferential spacings of the planetary rollers 428 are not kept apart by rings 334 and 336 but by gears 440 and 442 or toothed rings which are constituted on or affixed to the ends of the planetary rollers 426, and which mesh by their teeth with those of the gearing rings 446 respectively 448 that are constituted at or affixed to the drive spindle 432 on each side of its drive segment 330. The same reference numerals apply in FIG. 5 as they do in FIGS. 3 and 4 where the components are the same. Being functionally identical, they are not described again with respect to FIG. 5.

The invention claimed is:

1. A pad printing system comprising:

a first sub-assembly comprising a printing plate support, the first sub-assembly being movable in a first direction;

a second sub-assembly comprising an ink cup support, the second sub-assembly being movable in a second direction substantially parallel to the first direction;

a third sub-assembly comprising a printing pad support, the third sub-assembly being movable in a third direction different from the first direction and the second direction;

a fourth sub-assembly comprising an object carrier configured to accommodate an object to be printed, the fourth sub-assembly being movable in a fourth direction;

a first platform having a first surface along which the first sub-assembly is movable;

a second platform having a second surface along which the fourth sub-assembly is movable, the second platform being separated from the first platform by a distance in the third direction;

a first electrical, adjusting linear-actuator mechanically connected with said first sub-assembly to move the first sub-assembly relative to the second sub-assembly;

a second electrical, adjusting linear-actuator mechanically connected with said second sub-assembly to move the second sub-assembly relative to the first sub-assembly;

a third electrical, adjusting linear-actuator mechanically connected with said third sub-assembly to move the second sub-assembly relative to the first sub-assembly; and a fourth electrical, adjusting linear-actuator mechanically connected with said fourth sub-assembly to move the fourth sub-assembly relative to the third sub-assembly, wherein at least one of the first electrical, adjusting linear-actuator, the second electrical adjusting linear actuator, the third electrical, adjusting linear-actuator, or the fourth electrical, adjusting linear-actuator is fitted with an inverted planetary roller threaded drive.

2. A pad printing system as claimed in claim 1, wherein the first sub-assembly further comprises a printing plate.

3. A pad printing system as claimed in claim 1, further comprising:

a programmed or programmable control is connected to the linear adjusting actuator to control the linear adjusting actuator.

4. A pad printing system as claimed in claim 1, wherein at least one of the first electrical, adjusting linear-actuator, the second electrical, adjusting linear-actuator, the third electrical, adjusting linear-actuator, or the fourth electrical adjusting linear-actuator includes (i) a drive spindle including a drive segment or (ii) a drive spindle to which a drive segment is irrotationally joined thereto, wherein the respective drive segments include a plurality of individual annular grooves, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the plurality of individual annular grooves and the female thread, and wherein the actuator includes a ring that maintains the planetary rollers apart from one another.

5. A pad printing system as claimed in claim 1, wherein at least one of the first electrical, adjusting linear-actuator, the second electrical, adjusting linear-actuator, the third electrical, adjusting linear-actuator, or the fourth electrical, adjusting linear-actuator includes (i) a drive spindle including a drive segment or (ii) a drive spindle to which a drive segment is irrotationally joined thereto, wherein the respective drive segments include a male threaded groove, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the threaded groove and the female thread, and wherein the actuator includes a ring that maintains the planetary rollers apart from one another.

6. A pad printing system as claimed in claim 1, wherein at least one of the first electrical, adjusting linear-actuator, the second electrical, adjusting linear-actuator, the third electrical, adjusting linear-actuator, or the fourth electrical, adjusting linear-actuator includes (i) a drive spindle including a drive segment or (ii) a drive spindle to which a drive segment is irrotationally joined thereto, wherein the respective drive segments include a plurality of individual annular grooves, wherein the actuator includes a female component that surrounds a longitudinal axis of the drive segment and includes female thread also surrounding the longitudinal axis, and wherein the actuator includes planetary rollers located between the female component and the respective drive segment, wherein the planetary rollers directly interface with the plurality of individual annular grooves and the female thread, and wherein respective gears or toothed rings are located on ends of respective planetary rollers and which mesh via the teeth thereof with gearing that is part of or is mechanically fixed to the drive spindle.

7. A pad printing system as claimed in claim 1, wherein at least one of the first electrical, adjusting linear-actuator, the second electrical, adjusting linear-actuator, the third electrical, adjusting linear-actuator, or the fourth electrical, adjusting linear-actuator includes (i) a drive spindle including a drive segment or (ii) a drive spindle to which a drive segment is irrotationally joined thereto, wherein the respective drive segments include a male threaded groove, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the threaded groove and the female thread, and wherein respective gears or toothed rings are located on ends of respective planetary rollers and which mesh via the teeth thereof with gearing that is part of or is mechanically fixed to the drive spindle.

8. A pad printing system as claimed in claim 1, wherein the second sub-assembly further comprises an ink cup accommodated by the ink cup support, and the third sub-assembly further comprises a printing pad attached to the pad support.

9. A pad printing system comprising:

a first sub-assembly comprising a printing plate support, the first sub-assembly being movable in a first direction;

a second sub-assembly comprising an ink cup support, the second sub-assembly being movable in a second direction parallel to the first direction;

a third sub-assembly comprising a printing pad support, the third sub-assembly being movable in a third direction perpendicular to the first direction and the second direction;

a fourth sub-assembly comprising an object carrier configured to accommodate an object to be printed, the fourth sub-assembly being movable in a fourth direction;

a first platform having a first surface along which the first sub-assembly is movable;

a second platform having a second surface along which the fourth sub-assembly is movable, the second platform being separated from the first platform by a distance in the third direction;

a first linear actuator mechanically connected with said first sub-assembly to move the first sub-assembly relative to the second sub-assembly;

a second linear actuator mechanically connected with said second sub-assembly to move the second sub-assembly relative to the first sub-assembly;

a third linear actuator mechanically connected with said third sub-assembly to move the second sub-assembly relative to the first sub-assembly; and a fourth linear actuator mechanically connected with said fourth sub-assembly to move the fourth sub-assembly relative to the third sub-assembly, wherein the first linear actuator has a range of motion that causes the printing plate support to intersect an axis of movement of the third sub-assembly along the third direction, and at least one of the first linear actuator, the second linear actuator, the third linear actuator, or the fourth linear actuator comprises an inverted planetary roller threaded drive.

10. A pad printing system as claimed in claim 9, wherein the first sub-assembly further comprises a printing plate.

11. A pad printing system as claimed in claim 9, wherein the second sub-assembly further comprises an ink cup accommodated by the ink cup support.

12. The pad printing machine as claimed in claim 9, wherein the third sub-assembly further comprises a printing pad attached to the pad support.

13. A pad printing system as claimed in claim 9, wherein at least one of the first linear actuator, the second linear actuator, the third linear actuator, or the fourth linear actuator includes (i) a drive spindle including a drive segment or (ii) a drive spindle to which a drive segment is irrotationally joined thereto, wherein the respective drive segments include a plurality of individual annular grooves, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the plurality of individual annular grooves and the female thread, and wherein the actuator includes a ring that maintains the planetary rollers apart from one another.

14. A pad printing system as claimed in claim 9, wherein at least one of the first linear actuator, the second linear actuator, the third linear actuator, or the fourth linear actuator includes (i) a drive spindle including a drive segment or (ii) a drive spindle to which a drive segment is irrotationally joined thereto, wherein the respective drive segments include a male threaded groove, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the threaded groove and the female thread, and wherein the actuator includes a ring that maintains the planetary rollers apart from one another.

15. A pad printing system as claimed in claim 9, wherein at least one of the first linear actuator, the second linear actuator, the third linear actuator, or the fourth linear actuator includes (i) a drive spindle including a drive segment or (ii) a drive spindle to which a drive segment is irrotationally joined thereto, wherein the respective drive segments include a plurality of individual annular grooves, wherein the actuator includes a female component that surrounds a longitudinal axis of the drive segment and includes female thread also surrounding the longitudinal axis, and wherein the actuator includes planetary rollers located between the female component and the respective drive segment, wherein the planetary rollers directly interface with the plurality of individual annular grooves and the female thread, and wherein respective gears or toothed rings are located on ends of respective planetary rollers and which mesh via the teeth thereof with gearing that is part of or is mechanically fixed to the drive spindle.

16. A pad printing system as claimed in claim 9, wherein at least one of the first linear actuator, the second linear actuator, the third linear actuator, or the fourth linear actuator includes (i) a drive spindle including a drive segment or (ii) a drive spindle to which a drive segment is irrotationally joined thereto, wherein the respective drive segments include a male threaded groove, wherein the actuator includes a female component that surrounds a longitudinal axis of the drive segment and includes female thread also surrounding the longitudinal axis, wherein the actuator includes planetary rollers located between the female component and the respective drive segment, wherein the planetary rollers directly interface with the threaded groove and the female thread, and wherein respective gears or toothed rings are located on ends of respective planetary rollers and which mesh via the teeth thereof with gearing that is part of or is mechanically fixed to the drive spindle.

17. A pad printing system, comprising:

a rotatable platform;

a pad printing machine on the rotatable platform, the pad printing machine comprising:

a first sub-assembly comprising a printing plate support, the first sub-assembly being movable in a first direction;

a second sub-assembly comprising an ink cup support, the second sub-assembly being movable in a second direction parallel to the first direction;

a third sub-assembly comprising a printing pad support, the third sub-assembly being movable in a third direction perpendicular to the first direction and the second direction;

a first platform having a first surface along which the first sub-assembly is movable;

a second platform having a second surface along which the fourth sub-assembly is movable, the second platform being separated from the first platform by a distance in the third direction;

a first linear actuator mechanically connected with said first sub-assembly to move the first sub-assembly relative to the second sub-assembly;

a second linear actuator mechanically connected with said second sub-assembly to move the second sub-assembly relative to the first sub-assembly; and a third linear actuator mechanically connected with said third sub-assembly to move the second sub-assembly relative to the first sub-assembly; and a printing station adjacent the rotatable platform, the printing station comprising:

a fourth sub-assembly comprising an object carrier configured to accommodate an object to be printed, the object carrier being movable in a fourth direction; and a fourth linear actuator mechanically connected with said fourth sub-assembly to move the object carrier relative to the third sub-assembly in the fourth direction;

wherein at least one of the first linear actuator, the second linear actuator, the third linear actuator, the fourth linear actuator, or the fifth linear actuator comprises an inverted planetary roller threaded drive.

18. The printing pad system according to claim 17, further comprising:

a fifth linear actuator mechanically connected with said rotatable platform to cause the third sub-assembly to be positioned such that an axis of movement of the third sub-assembly intersects an axis of movement of the object carrier.

19. The printing pad system according to claim 17, wherein the printing pad machine is one of at least two printing pad machines on the rotatable platform, and the rotatable platform is configured to facilitate each of the printing machines applying an ink-based image onto an object accommodated by the object carrier.

* * * * *